US012281875B2

(12) United States Patent
Rushforth et al.

(10) Patent No.: US 12,281,875 B2
(45) Date of Patent: Apr. 22, 2025

(54) PROJECTILE LAUNCH APPARATUS FOR USE IN FLUID ENVIRONMENTS

(71) Applicant: The Secretary of State for Defence, Salisbury (GB)

(72) Inventors: Peter Richard Rushforth, Salisbury (GB); David Timothy Newell, Salisbury (GB)

(73) Assignee: The Secretary of State for Defence, Salisbury (GB)

( * ) Notice: Subject to any disclaimer, the term of this patent is extended or adjusted under 35 U.S.C. 154(b) by 41 days.

(21) Appl. No.: 18/252,739

(22) PCT Filed: Nov. 11, 2021

(86) PCT No.: PCT/GB2021/000122
§ 371 (c)(1),
(2) Date: May 12, 2023

(87) PCT Pub. No.: WO2022/101599
PCT Pub. Date: May 19, 2022

(65) Prior Publication Data

US 2024/0003659 A1 Jan. 4, 2024

(30) Foreign Application Priority Data

Nov. 16, 2020 (GB) ..... 2017969

(51) Int. Cl.
*F41F 3/10* (2006.01)
*F42B 10/38* (2006.01)
(Continued)

(52) U.S. Cl.
CPC ..... *F41F 3/10* (2013.01); *F42B 10/38* (2013.01); *F42B 14/02* (2013.01); *F42B 17/00* (2013.01); *F42B 19/125* (2013.01)

(58) Field of Classification Search
CPC ..... F41F 3/10; F42B 10/38; F42B 19/125
See application file for complete search history.

(56) References Cited

U.S. PATENT DOCUMENTS 6,405,653 B1 * 6/2002 Miskelly ..... F42B 15/20 89/1.807
6,739,266 B1 * 5/2004 Castano ..... F42B 10/38 114/20.1

(Continued)

FOREIGN PATENT DOCUMENTS

GB 2407148 A 4/2005
WO 2008105930 A2 9/2008

OTHER PUBLICATIONS

International Patent Application No. PCT/GB2021/000122, International Preliminary Report on Patentability mailed May 25, 2023, 8 pages.

(Continued)

*Primary Examiner* — J. Woodrow Eldred
(74) *Attorney, Agent, or Firm* — Kilpatrick Townsend & Stockton LLP

(57) ABSTRACT

Projectile launch apparatus (20) for use in a fluid environment. The apparatus (20) comprises a launch tube (21) having a supercavitating projectile (24) with cavitator (29) received within the launch tube (21). A means for generating expulsion gas (not visible) is arranged to provide expulsion gas to propel the projectile (24) from the launch tube (21), with means for bleeding expulsion gas (31, 32) being provided to bleed a portion of expulsion gas around the projectile (24). This allows expulsion gases to contribute to the formation of the gas cavity around the supercavitating projectile (24) as the projectile (24) is launched from the launch tube (21). Particularly suited to the deployment of (Continued)

supercavitating projectiles underwater, such as in underwater mine disposal applications.

24 Claims, 3 Drawing Sheets

(51) Int. Cl.

| | |
|---|---|
| ***F42B 14/02*** | (2006.01) |
| ***F42B 17/00*** | (2006.01) |
| ***F42B 19/12*** | (2006.01) |

(56) References Cited

U.S. PATENT DOCUMENTS

| | | | | |
|---|---|---|---|---|
| 7,347,146 | B1 * | 3/2008 | Gieseke | F42B 10/38 102/341 |
| 2009/0071386 | A1 | 3/2009 | Minehart, III | |

OTHER PUBLICATIONS

United Kingdom Patent Application No. GB2017969.3, Search Report dated Apr. 28, 2021, 3 pages.
International Patent Application No. PCT/GB2021/000122, International Search Report and Written Opinion mailed Feb. 14, 2022, 15 pages.
United Kingdom Patent Application No. GB2116289.6, Combined Search and Examination Report dated May 3, 2022, 2 pages.

* cited by examiner

PROJECTILE LAUNCH APPARATUS FOR USE IN FLUID ENVIRONMENTS

TECHNICAL FIELD OF THE INVENTION

This invention relates to the field of supercavitating projectiles and associated launching systems for use in fluid environments, and in particular to such projectiles and systems for use underwater.

BACKGROUND TO THE INVENTION

The motion of a projectile through a fluid is affected by hydrodynamic drag. In particular, the achievable velocity of an underwater projectile is significantly affected. A major contributing factor to this limitation is skin drag—the friction between the surface of a projectile and the water or other fluid within which the projectile is moving. Reducing skin drag is an important consideration in maximising the performance of both air based projectiles and more particularly underwater projectiles.

It is possible to reduce skin drag by generating a supercavitating flow around a projectile as it moves through a fluid. Supercavitating projectile designs typically comprise a structural element known as a cavitator on the forward section (typically at or near the nose) of the projectile. In an underwater environment the cavitator contacts the water during motion of the projectile, causing phase change of the water to vapour at high projectile speeds. As a result the remainder of the projectile mostly contacts the vapour vice the liquid water itself, leading to a substantial reduction in overall skin drag. Ultimately this allows supercavitating projectiles to achieve much higher velocities than are achievable with non-supercavitating designs.

However despite advances in supercavitating projectile designs, there still exists a period of time immediately after a projectile is launched during which skin drag is significant. During this period of time the projectile is accelerating and a supercavitating flow is yet to be fully formed around the projectile. Projectile surfaces continue to experience substantial friction effects during this period. Furthermore, projectile contact with the launch tube during launch further adds to friction effects, decreasing overall performance.

Therefore it is an aim of the present invention to provide a projectile launch apparatus that mitigates these issues.

SUMMARY OF THE INVENTION

According to a first aspect of the invention, there is provided a projectile launch apparatus for use in fluid environments, comprising a launch tube having a closed end and an open end, a supercavitating projectile received between the ends separating the launch tube into a forward section comprising the open end and a rear section comprising the closed end, and gas generation means arranged to provide expulsion gas into the rear section of the launch tube, such that in-use trapped expulsion gases within the rear section generate a pressure increase that acts on the supercavitating projectile to propel the projectile through the open end, wherein the supercavitating projectile comprises a nose section and a tail section, the nose section having a cavitator for generating a gas cavity around the supercavitating projectile when the projectile is launched, wherein the projectile launch apparatus further comprises means for bleeding expulsion gases around the projectile from the rear section of the launch tube into the forward section and thereby to the open end, such that in-use the expulsion gases can contribute to the formation of the gas cavity around the supercavitating projectile as the projectile is launched through the open end.

A supercavitating projectile generates a supercavitating flow around a projectile (a gas cavity formed of many gas bubbles) as the projectile moves through a fluid. This supercavitating flow does not fully form until after a projectile has been launched, and the projectile has attained sufficient velocity to encourage a supercavitation effect from the surrounding fluid. Prior to this, and in particular as the projectile exits a launch tube, there is a period of substantial skin drag during which overall performance of the projectile can be affected. Furthermore there are friction effects between the projectile and the launch tube itself as a result of physical contact during launch. By bleeding a portion of expulsion gas from the rear section of the launch tube around the projectile and into the forward section, a gas cavity is created around the projectile as the projectile propagates along the launch tube and exits through the open end of the launch tube. This reduces friction effects during launch and in particular the skin drag immediately experienced by the projectile as it exits the launch tube. Furthermore this gas bubble has been shown by the inventor to coalesce with the supercavitating flow being formed by the cavitator on the nose section of the projectile as it moves through a fluid. This leads to faster formation of a complete gas bubble surrounding the projectile outside of the launch tube, and the benefits of reduced skin drag being experienced earlier during launch of the projectile. Ultimately this enables the use of high pressure gas instead of propellant as a propulsion system for the supercavitating projectile, leading to increased operational safety and/or reduced projectile weight.

The launch tube is a hollow elongated structure having two opposing ends and from which the projectile is launched. Preferably the launch tube is cylindrical having a circular cross section compatible with supercavitating projectiles having circular cross sections. The bore of the launch tube is preferably smooth so as not to inhibit projectile launch. The launch tube has a closed end and an open end. The closed end prevents expulsion gases escaping such that in use said gases can be trapped and increase pressure in the rear section of the launch tube to propel the projectile from the launch tube. The open end is the opposite end of the launch tube and defines an aperture through which the supercavitating projectile can be launched. The open end may comprise a temporary breakable seal, rupture disc, end cap, or cover, to prevent fluid (such as water) ingress into the launch tube prior to projectile launch. Any such temporary cover of the open end of the launch tube is breakable by either the projectile itself when launched or by the high pressure gases bleeding into the forward section of the launch tube. The launch tube may be formed from metal, preferably a metal such as steel, titanium, metal alloys, or surface treated metals such as anodised or coated aluminium, that will not corrode with prolonged or repeated use in a particular fluid such as water. Alternatively the launch tube may be formed from ceramic or carbon fibre. Such materials can be manufactured to have yield stresses high enough tolerate the high pressures generated during launch.

The supercavitating projectile may be an underwater bullet, spear, dart, or torpedo. Preferably the projectile is an underwater dart for mine disposal. The projectile may be a solid mass or define one or more hollow regions suitable for carrying a payload. The projectile may be formed as a single component or as multiple components attached together using welding, bolts, or other attachment means. Preferably the projectile has a length of between 2 cm and 250 cm, and more preferably a length between 10 cm and 80 cm. The projectile may have a diameter of between 1 cm and 30 cm, and more preferably between 2 cm and 10 cm. Such dimensions have been found to be particularly suitable for underwater darts. Generally for supercavitating projectiles a diameter to length ratio of 1:4 up to 1:16 has been found favourable depending upon fluid through which a projectile is propagating and the velocity of the projectile itself. The launch tube is appropriately sized to accommodate the given dimensions of a projectile. The projectile may be formed from any suitable material but in preferred embodiments Tungsten, Hardened Steel, treated or coated Aluminium or metal alloys (such as Inconel) are used, which have been shown to provide good penetration performance, particularly for penetration of underwater mine casings.

The supercavitating projectile comprises a nose section which is intended to comprise the forward most section of the projectile with regard to the direction of travel of the projectile when launched. This nose section may comprise a detachable or sacrificial portion that encloses other parts of the nose section of the projectile. For instance the needle like penetrator of a dart may be enclosed within a frangible part of nose section until the point of impact with a target, at which point that part of the nose section may break apart revealing and allowing penetration of the dart. As such the nose portion of the supercavitating projectile may additionally comprise structurally weaker materials than the rest of the projectile, for instance plastics, ceramics, or metal sheet may be used. However any such material must have structural strength suitable for tolerating the propulsion of the projectile through a fluid.

The nose section of the supercavitating projectile comprises a cavitator for generating a cavitation gas cavity around the projectile when the projectile is launched. The cavitator encourages the formation of vapour bubbles as the projectile transits through water or other fluid. The cavitator may comprise a single blunt end, or may be of a more complex designs such as a plurality of stacked plates or stacked cylindrical sections of different diameters, and having different angles and/or recesses to encourage supercavitating flow.

The supercavitating projectile may further comprise one or more sensors at or in the vicinity of the nose section of the projectile. The sensors may be utilised to provide targeting information or sensing, such as proximity sensing. Information generated from the sensor may be used by the projectile to trigger other actions such as arming or detonation through use of on-board data processing means. The sensors may also aid in target homing/tracking.

In some embodiments it may be advantageous to induce a rotation of the supercavitating projectile during launch to improve stability. This may be achieved by providing helical grooves around the exterior of the projectile (for instance in the exterior surface of the projectile casing) along the main longitudinal axis of the projectile for interacting with the fluid environment. These grooves may extend partway or completely along the length of the projectile.

The nose section of the supercavitating projectile may in some embodiments be rotationally independent to the remainder of the supercavitating projectile. During use, a rotation of the supercavitating projectile may occur as a result of fluid impinging on the supercavitating nose design or remainder of the projectile body, inducing rotation about the main longitudinal axis of the projectile. This may be dependent upon projectile design—certain cavitators may induce such rotation, or alternatively fins protruding from the projectile main body (optionally deployed post launch) and out of the supercavitating bubble into the surrounding fluid could induce body rotation (for instance such fins may present an angle of attack to the impinging fluid). This can result in reduced stability of the projectile following deployment, in particular of the supercavitating effect. By rotationally decoupling the nose section from the remainder of the projectile using decoupling means, this effect can be reduced, improving overall stability. Such rotational decoupling may be introduced through connection of the nose section to a central axial shaft of the main projectile body using bearings, for instance, such that the nose section can remain stable whilst the main body rotates, or vice versa.

The supercavitating projectile is received within the launch tube between the ends of the launch tube so as to separate the launch tube into forward and rear sections. Expulsion gases from the gas generation means can therefore be trapped within the rear section of the launch tube, allowing a gas pressure within the rear section to increase, thereby generating the propulsion required to force the projectile from the launch tube and towards an intended target. Whilst prior art devices are designed to maximise the strength of the seal between the projectile and launch tube in order to maximise launch pressure, the inventor has shown contrary to this teaching, that during the launch of a supercavitating projectile there is a benefit in actually bleeding a portion of expulsion gas to the forward section of the launch tube to contribute to gas cavity formation around the projectile, as the projectile is launched.

This reduces drag effects on the projectile as it exits the launch tube. As a result, a more efficient transfer of stored energy from the gas generation means can be transferred to the projectile, enabling a lower launch pressure to be used to achieve similar projectile performance. This is achieved through use of a suitable means for bleeding expulsion gas.

The gas generation means may form part of the launch tube. For instance the gas generation means may comprise a propellant chamber in fluid connection with the rear section of the launch tube and containing a propellant composition. The propellant composition may generate expulsion gas upon initiation. Alternatively the gas generation means may comprise high pressure gas injected into the rear section of the launch tube through a gas valve connected to a gas cylinder. In some embodiments the gas generation means may form part of the tail section of the supercavitating projectile. Either a propellant cartridge or motor may be used for this purpose, or a gas cylinder may also be used.

In some embodiments, the supercavitating projectile is banded with at least one discrete band to form a bore riding projectile. The band/s centre the projectile on the bore of the launch tube and engage and "ride along" the interior surface of the launch tube when the projectile is launched. This provides stability to the projectile as the projectile is propelled along the launch tube, minimising damage to the launch tube and projectile during launch.

Even more preferred is that the supercavitating projectile is banded with at least two discrete bands, even more preferably three discrete bands, providing further stability during launch.

The bands are attached or integrally formed with the projectile and exit the launch tube with the projectile itself. The bands have a diameter that substantially conforms to the interior surface of the launch tube, the remainder of the projectile having a reduced diameter. The bands may for instance protrude from the projectile by up to 5 mm, preferably by 0.5 mm up to 2 mm. The bands are preferably formed from a low friction or softer material than that of the launch tube so as to minimise damage to the launch tube when the projectile is launched.

For instance the bands may be formed from plastics such as Nylon or PTFE which also provides a low friction interface with the launch tube.

In some even more preferred embodiments the means for bleeding expulsion gas comprises conduits extending through the discrete bands for the flow of expulsion gases from the rear section to the forward section of the launch tube. The conduits may be one or more holes drilled through the bands for instance, to permit a controlled rate of flow of gas from the rear section to the forward section of the launch tube. The conduits may be parallel to the major axis of the projectile or may be angled thereto to promote rotation of the projectile as it moves along and exits the launch tube.

In certain embodiments the means for bleeding expulsion gas comprises a clearance gap between the exterior surface of the projectile and the interior surface of the launch tube. Whilst prior art devices seek to provide a sufficient interference fit between projectile and launch tube to minimise leakage of expulsion gases, the inventor has shown that a small clearance gap permits a controlled flow of expulsion gas from the rearward section of the launch tube to the forward section, thereby contributing to drag reduction as the projectile exits the launch tube. For embodiments comprising banded projectiles, the clearance gap is 50-500 micrometres between the exterior surface of the discrete bands and the interior surface of the launch tube. The clearance gap may extend partially or fully around the projectile and may form a structure on the surface to encourage rotation of the projectile. Even more preferred is that the clearance gap is formed of more than one diameter and less than 5% of the overall projectile diameter. For instance the clearance gap between the bands and inner surface of the launch tube may be 100 micrometres, but the clearance gap between the rest of the projectile body and the inner surface of the launch tube may be 2000 micrometres or less, preferably 1000 micrometres. A clearance gap ensures sufficient expulsion gas can flow to the forward section to contribute to the gas cavity around the projectile at the open end of the launch tube, but also ensures sufficient gas pressure is maintained in the rear section of the launch tube to propel the projectile from the launch tube. Additionally, for embodiments wherein the launch tube may be flooded with fluid prior to projectile launch, the clearance gap allows high pressure propulsion gases to assist with clearing the launch tube of fluid, again reducing skin drag for the projectile. A clearance gap may also enable mortar like operation of some embodiments, wherein a supercavitating projectile can be loaded into a launch tube and smoothly fall down the bore of the launch tube to the rear closed end wherein contact of the projectile directly with the means for generating expulsion gases, or with a valve (such as a breech valve or trigger valve) or the like for triggering the means for generating expulsion gases, initiates the launch of the projectile backout of the launch tube.

In certain embodiments the means for bleeding gas comprises a groove in the exterior surface of the projectile and/or the interior surface of the launch tube, the groove extending between the rear section and the forward section such that the exterior surface of the projectile and interior surface of the launch tube define a channel there between through which expulsion gases can flow. The grooves may be sized to permit a controlled flow of gas from the rear section to the forward section. There may be one or more grooves provided. The grooves may be parallel to the major axis of the projectile or may be angled thereto to promote rotation of the projectile as it moves along and exits the launch tube.

In some embodiments the supercavitating projectile comprises an internal conduit connecting the rear section of the launch tube with the forward section, through which expulsion gases can flow. The internal conduit may be linear and sized to permit a controlled flow of gas between the sections of the launch tube (and thereby control of gas pressure). Alternatively and preferred is that the internal conduit prescribes a spiral about the major axis of the projectile to impart a rotational effect to the projectile. The use of an internal conduit is beneficial as the conduit may be configured such that expulsion gases exit the internal conduit at the nose section of the projectile increasing the likelihood the gases will contribute to the supercavitation gas cavity formed in the region of the cavitator as the projectile moves through the fluid as it exits the launch tube.

In preferred embodiments the projectile launch apparatus further comprises initiation means for initiating the means for bleeding gas on demand or when the pressure in the rear section of the launch tube exceeds a predetermined threshold pressure value, for example 20-200 MPa. The initiation means may for instance comprise burst seals or discs arranged to cover or provide a plug-fit to conduits or grooves through which expulsion gases could flow between the sections of the launch tube. These burst seals or discs may be formed from materials that rupture above a predetermined threshold pressure value thereby permitting gas flow (for instance by manufacturing the seals or discs to specific dimensions that rupture at predetermined pressure thresholds). Preferably the initiation means comprises a shear band attached to the tail section of the projectile. The shear band may be attached to and retain the projectile in the launch tube, providing a gas tight seal between the rear section of the launch tube and the forward section, such that an initial threshold launch pressure can be established before the projectile is launched. Alternatively the shear band may be provided detached from the projectile and serve only to provide a fluid tight seal between propellant and the launch tube in the launch tube. The shear band is configured to fail at a predetermined threshold pressure value allowing the projectile to be propelled along the barrel, but also allowing expulsion gas to begin bleeding to the forward section of the launch tube. The shear band may be formed from plastics such as Nylon or PTFE or Polyurethane.

In some embodiments, the initiation means comprises an internal taper of the rear section of the launch tube and a conformal tapering of the tail end of the supercavitating projectile. The taper may be a Luer taper to provide a leak free interface. During launch as the projectile is urged from its starting position within the launch tube, the tapered interface is opened enabling the means for bleeding gas to be initiated by the flow of gases around the projectile proximal the taper.

In some embodiments the cavitator of the projectile comprises a plurality of stacked sections increasing in diameter in the nose-to-tail direction. Each section may be normal to the direction of travel of the projectile or may be angled to the normal. Some sections may be angled and others not. A plurality of stacked sections provides a plurality of sharp edges around which impinging fluid must accelerate as the supercavitating projectile transits through the fluid. This acceleration encourages vapour bubbles to form leading to formation of a supercavitating gas cavity around the projectile. Therefore a plurality of stacked sections improves the formation of the supercavitating gas cavity around the projectile. In even more preferred embodiments each of the plurality of stacked sections is cylindrical ensuring a uniform supercavitating effect is established around the projectile. Even more preferable is that the plurality of stacked sections comprises three or more stacked sections.

In certain preferred embodiments the cavitator comprises an annular recess extending around the periphery of the interface of each stacked section. As the supercavitating projectile propagates through a fluid, each annular recess encourages toroidal flow for fluid immediately proximal the cavitator. Over this toroidal flow, flow of fluid is improved. This provides improved skin drag for the supercavitating projectile.

Some embodiments further comprise an inflatable bladder having an opening for receiving a gas, the inflatable bladder being releasably mounted to the launch tube and arranged to receive through the opening a portion of the expulsion gas from the gas generation means when the projectile launch apparatus is in-use, such that the inflatable bladder can be used as a marker buoy. This allows the location of the launch of a supercavitating projectile to be determined from above water. The expulsion gas, which would otherwise be wasted after launch of the projectile, can be usefully applied as an inflation gas for an inflatable bladder serving as a marker buoy. The inflatable bladder itself is preferably formed from a flexible material such as flexible plastic to allow easy and compact stowage. The portion of expulsion gas may be provided through the opening of the inflatable bladder through a vent port attached to the gas generation means or a vent port in the launch tube and being in fluid connection with the rear section of the launch tube. The vent port may comprise a valve operable only at a certain pressure or at a certain time during the launch procedure. The vent port may be arranged in the forward section of the launch tube, such that a portion of expulsion gas can only escape through the vent port once the projectile has passed along the length of the launch tube. Alternatively and preferred is that the opening of the inflatable bladder is arranged to collect a portion of expulsion gas exiting the open end of the launch tube when the projectile launch apparatus is in use. Therefore expulsion gases exiting the launch tube are captured and utilised. In other embodiments the flexible bladder may form part of the projectile itself.

Even more preferred is that the inflatable buoy is attached to the launch tube or projectile using rope or wire means. This allows the recovery of the launch tube for re-use, or the location of the projectile post launch to be tracked. The latter being particularly relevant to underwater mine disposal operations where mine location identification and recovery may need to be instigated. The rope or wire means may be string, rope, or wire, and may be formed from any suitable material, such as metal or plastic or other synthetic or natural materials. Preferably carbon fibre rope is used optionally coated with PTFE or Teflon. This allows the rope to also operate as a communications route between the projectile and surface for instance, and yields a low electrical resistance per unit distance.

According to a second aspect of the invention there is provided a torpedo comprising the projectile launch apparatus of the first aspect of the invention. The projectile launch apparatus is intended to be scalable and may further be incorporated into other larger projectile systems such as torpedoes as a means for deploying payloads. Even more preferable is that the torpedo comprises a plurality of the projectile launch apparatuses, for instance with each launch tube being arranged in a cone pattern angled outwards about the longitudinal axis of the torpedo. This allows the overall payload (decomposed into the smaller supercavitating projectiles) to achieve greater range and area deployment than a single torpedo in isolation.

According to a third aspect of the invention there is provided a method of launching a supercavitating projectile into a fluid environment, the method comprising the steps of: locating the projectile launch apparatus of the first aspect of the invention in a fluid environment; initiating the gas generation means to provide expulsion gas into the rear section of the launch tube; bleeding expulsion gas around the projectile from the rear section of the launch tube into the forward section of the launch tube and thereby to the open end; and then launching the supercavitating projectile through the open end of the launch tube, such that the expulsion gases can contribute to the formation of the gas cavity around the supercavitating projectile as the projectile is launched through the open end.

According to a fourth aspect of the invention there is provided the use of means for bleeding expulsion gases to bleed expulsion gases from a gas generation means of a projectile launch apparatus around a supercavitating projectile received within a launch tube of the projectile launch apparatus in order to reduce friction and drag effects acting on the supercavitating projectile when the supercavitating projectile is launched from the launch tube into a fluid environment.

Contrary to the teaching of prior art launch apparatuses, the inventor has shown that bleeding expulsion gases from the rear section of a launch tube around a supercavitating projectile to the forward section during launch of a supercavitating projectile can assist in the formation of a gas cavity around the projectile as the projectile is launched from a launch tube. This leads to an earlier reduction in skin drag, improving overall supercavitating projectile performance. Of particular benefit to underwater applications, similar benefits may be realised when launching supercavitating projectiles into other liquids or fluids such as with supercavitating projectiles launched into air, or when launching projectiles from one fluid to another such as from air to water. Some benefits of reduced friction when controllably bleeding expulsion gases around projectiles in launch tubes during launch may extend to projectiles without supercavitating features.

BRIEF DESCRIPTION OF THE DRAWINGS

Embodiments of the invention will now be described by way of example only and with reference to the accompanying drawings, in which.

DETAILED DESCRIPTION

Figure 1:
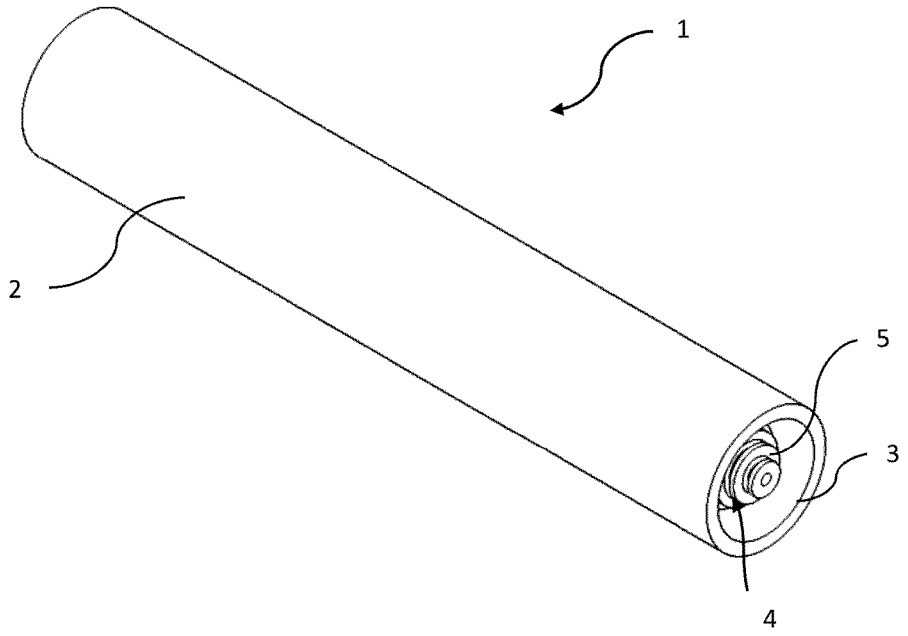
FIG. 1 provides an illustration in perspective view of an embodiment of a projectile launching apparatus for use in an underwater environment.

FIG. 1 provides an illustration in perspective view of an embodiment of a projectile launching apparatus 1 for use in an underwater environment. The apparatus 1 comprises a cylindrical launch tube 2 having a closed end (not visible) and an open end 3. A cylindrical bore is evident at the open end 3 of the launch tube 2 into which a supercavitating projectile 4 has been received. The supercavitating projectile 4 has a circular cross section substantially conformal to the interior surface of the launch tube 2. The supercavitating projectile 4 further comprises a cavitator 5 on a nose section of the projectile 4 and visible through the open end 3 of the launch tube. The cavitator 5 itself comprises a plurality of stacked cylindrical sections. The tail end of the projectile 4 is not visible. The launch tube 2 is approximately 30 cm in length, has an internal diameter of approximately 4 cm, and is formed from stainless steel. The supercavitating projectile is formed from aluminium.

Figure 2:
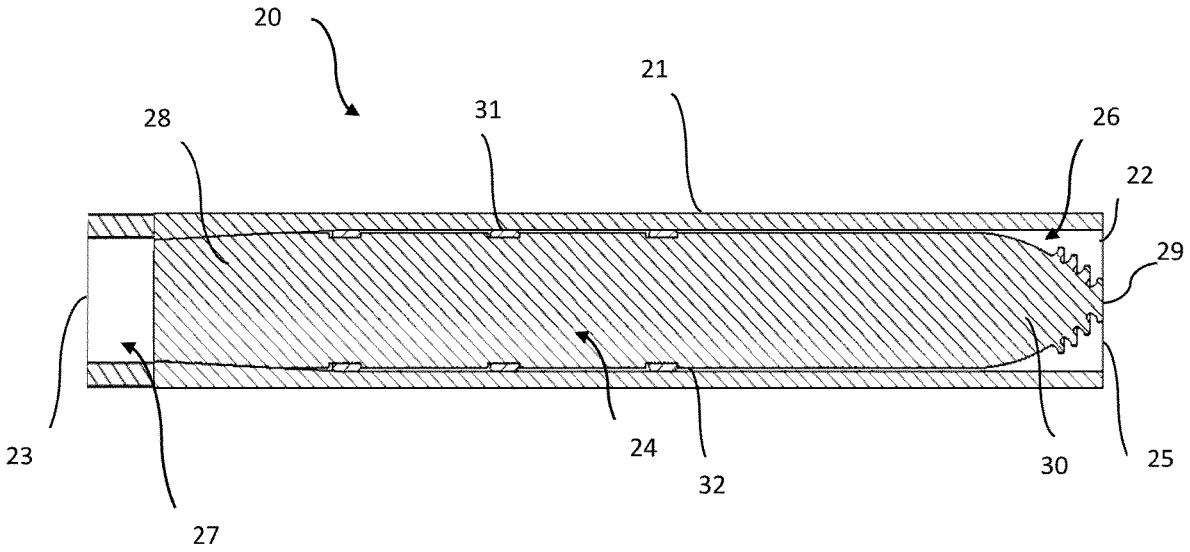
FIG. 2 provides an illustration in cutaway side view of an embodiment of a projectile launching apparatus for use in an underwater environment.

FIG. 2 provides an illustration in cutaway side view of an embodiment of a projectile launching apparatus 20 for use in an underwater environment. A launch tube 21 is shown having an open end 22 and a closed end 23. A supercavitating projectile 24 is shown received into the launch tube 21, the launch tube comprising a breakable seal 25 over the open end. The breakable seal 25 is formed from a frangible plastic and seals the launch tube from water ingress prior to launch of the projectile 24. The seal 25 is breakable by action of the projectile 24 urging against it during launch. The supercavitating projectile 24 divides the launch tube into a forward section 26 comprising the open end 22 of the launch tube 21, and a rear section 27 comprising the closed end 23 of the launch tube 21. The supercavitating projectile 24 is conformal to the interior surface of the launch tube 21 and provides a close fit. The tail section 28 of the projectile 24 comprises a taper that interfaces with a cooperating taper of the launch tube 21. This seals the rear section 27 of the launch tube 21 from the forward section 26. The supercavitating projectile 24 also comprises a cavitator 29 at the nose section 30 proximate the open end 22 of the launch tube 21. The cavitator 29 comprises a plurality of stacked circular sections of increasing diameter in the nose section 30 to tail section 28 direction. The supercavitating projectile 24 is formed from metal and has a lower caliber than the launch tube 21. The projectile 24 further comprises three peripheral Nylon bands 31 encircling the projectile 24 at three distinct locations along its length. The bands 31 increase the diameter of the projectile 24 to substantially the bore diameter of the launch tube 21. A small clearance gap 32 of 1 mm is provided between the surface of the supercavitating projectile 24 and the interior surface of the launch tube 21. The clearance gap 32 extends along the long of the projectile 24, but does not extend to the tail section 28 of the projectile which provides a Luer fit to the launch tube 21. The propulsion means is not visible but comprises a high pressure gas cylinder located in the tail section 28 of the projectile 24. The high pressure gas cylinder is able to vent high pressure gas into the rear section 27 of the launch tube 21 in order to propel the projectile 24 from the tube 21. The supercavitating projectile 24 is shown as a single unitary mass of aluminium approximately 30 cm in length and with a diameter of 4 cm. The launch tube 21 is also made of metal with dimensions configured to suit the projectile.

Figure 3:
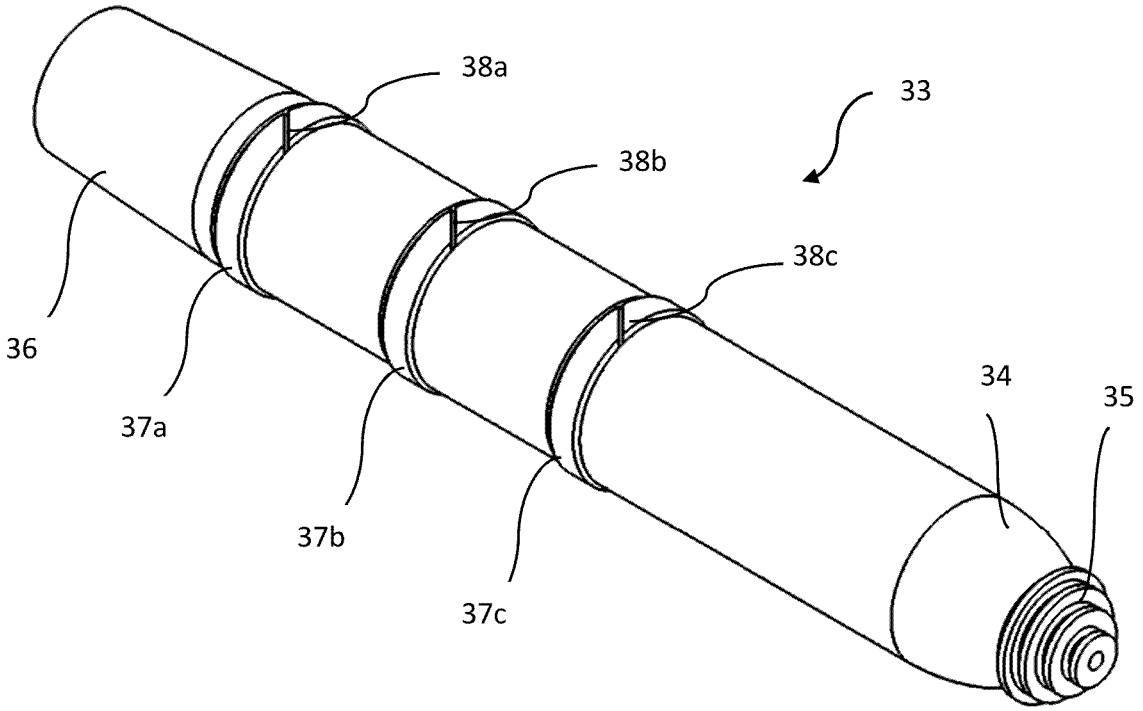
FIG. 3 provides an illustration in perspective view of an embodiment of a supercavitating projectile for use in a projectile launching apparatus.

FIG. 3 provides an illustration in perspective view of an embodiment of a supercavitating projectile 33 for use in a projectile launching apparatus. The projectile 33 is shown without a launch tube to illustrate the construction and geometry. The projectile 33 is formed from metal as a cylindrical unitary mass. It comprises a nose section 34 that gradually tapers in an ogive geometry towards a cavitator 35 at the front of the projectile 33. The cavitator 33 comprises four cylindrical stacked sections approximating plates of increasing diameter in the nose-section 34 to tail-section 36 direction. At the interface of each stacked section there is a recess to encourage improved supercavitating flow. The cavitator 33 impacts the fluid through which the projectile 33 is propagating and generates a supercavitating flow around the projectile 33. The tail section 36 is shown comprising a taper in the nose section 34 to tail section 36 direction. This is a Luer taper for interfacing with a compatible launch tube. Three discrete peripheral bands 37 of Nylon are shown encircling the projectile 33 at discrete points along its length. The bands 37 are attached to the projectile 33 and provide an increased projectile diameter such that the projectile 33 can effectively ride the bore of a launch tube. The bands 37 are shown comprising a split 38 to enable easier fitment onto the projectile.

Figure 4:
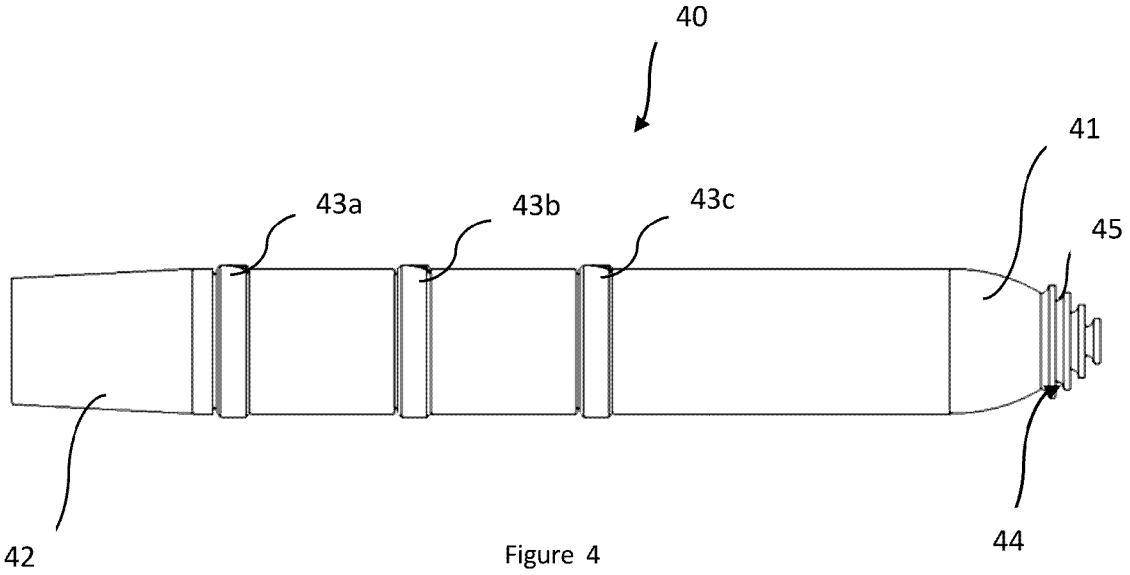
FIG. 4 provides an illustration in side view of an embodiment of a supercavitating projectile for use in projectile launching apparatus.

FIG. 4 provides an illustration in side view of an embodiment of a supercavitating projectile 40 for use in a projectile launching apparatus. The side view illustration is provided to aid the explanation of the geometry of the projectile 40. The projectile 40 has a circular cross section and forms an elongate cylinder of unitary mass comprising a nose section 41 and a tail section 42, the latter comprising a Luer taper. The unitary mass is formed from metal. Three distinct bands 43 are shown encircling the projectile 40 at different points along its length. The bands 43 are glued to the projectile 40. The bands 43 minimally increase the overall diameter of the projectile 40, in this embodiment the bands 43 increase the diameter by up to 1 mm. The bands 43 are formed of Nylon which exerts less wear onto a launch tube from which the projectile 40 is launched. At the nose section 41 there is also a tapering towards the front of the projectile 40, the tapering being ogive. Attached to the front of the nose section 41 is a cavitator 44 comprising four cylindrical stacked sections of increasing diameter in the nose section 41 to tail section 42 direction. The overall diameter of the cavitator 44 is less than the overall diameter of the projectile 40. At the interface of each stacked section in the cavitator there is a recess 45. The recess 45 encourages toroidal flow of fluid, such that laminar flow can be achieved over the toroidal flow, thereby improving overall skin drag for the projectile 40.

Figure 5A:
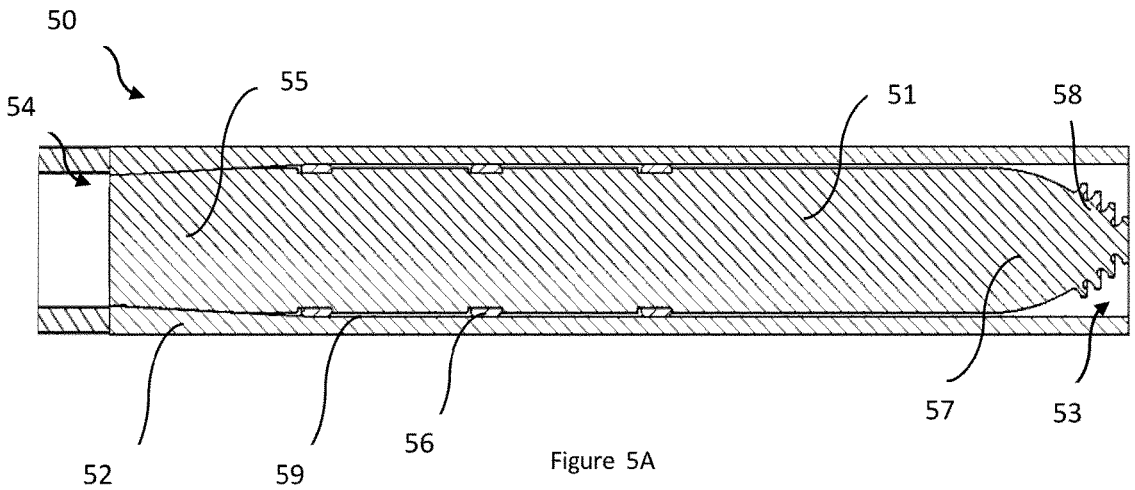
FIGS. 5*a*, 5*b*, and 5*c*, provide an illustration in cutaway side view of an embodiment of a supercavitating projectile at various stages during launch from a launch tube in a projectile launching apparatus.
Figure 5B:
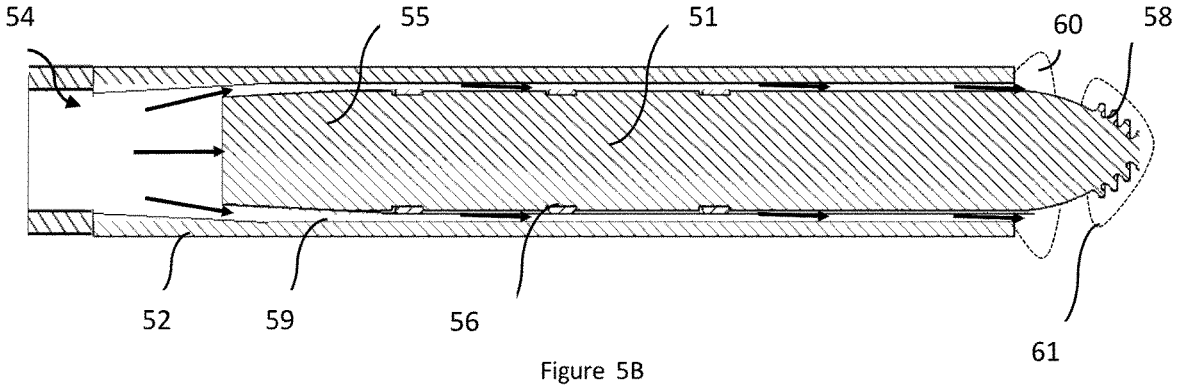
Figure 5C:
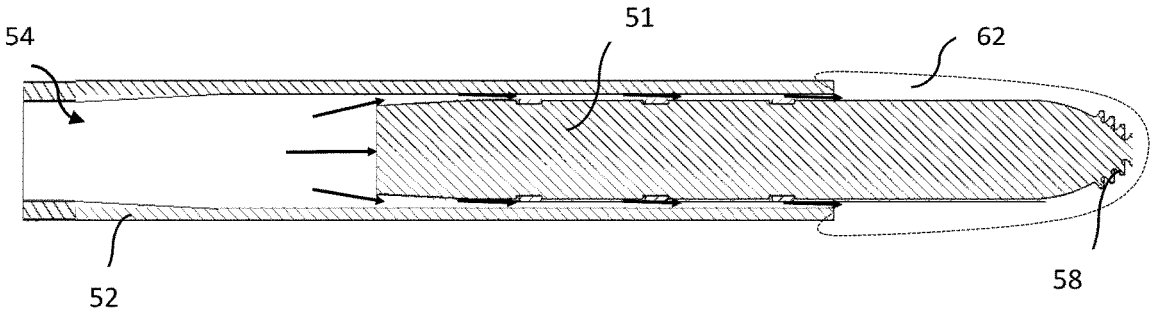

FIGS. 5*a*, 5*b* and 5*c* provide an illustration in cutaway side view of an embodiment of a supercavitating projectile 51 being launched from a launch tube 52 in a projectile launching apparatus 50. With regard to FIG. 5*a*, a supercavitating projectile 51 is shown within a launch tube 52. The launch tube 52 lacks a breakable seal and so prior to launch the launch tube 52 is flooded by fluid from the fluid environment of use. The supercavitating projectile 51 is therefore immersed in the fluid in the launch tube 52. The supercavitating projectile 51 substantially conforms to the interior surface of the launch tube 52. The tail section 55 of the projectile 51 comprises a Luer taper and cooperates with a corresponding tapering of the launch tube 52 to provide a seal and prevent fluid ingress behind the projectile 51. This separates the launch tube 52 into a forward section 53 and a rear section 54. The nose section 57 of the projectile 51 comprises a cavitator 58 for generating supercavitating flow around the projectile 51 once launched. The projectile 51 also comprises banding 56 to ride along the interior surface of the launch tube 52. Apart from the Luer taper of the tail section 55 of the projectile 51, there is a clearance gap 59 of approximately 1 mm between the the main body of projectile 51 and launch tube 52, and a smaller gap of 100 micrometres between the banding 56 and the launch tube 52.

In FIG. 5*a* the projectile 55 is in a pre-launch configuration, with the apparatus 50 itself being within an underwater environment.

FIG. 5*b* illustrates a later stage during launch of the projectile 51 from launch tube 52. High pressure gas from a gas canister within the tail section 55 of the projectile 51 has been expelled into the originally sealed rear section 54 of the launch tube. The build up of high pressure gases has urged the projectile 51 partially through the open end of the launch tube 52. This has separated the seal between the tail section 55 of the projectile and rear section 54 of the launch tube 52 originally formed by the Luer taper. As a result, a portion of expulsion gases controllably bleed past the tail section 55 of the projectile 51, past the bands 56, and out of the launch tube 52 at the open end. This gas flow is indicated by the bold arrows in the figure. These gases force fluid from the launch tube 52 and form a gas bubble 60 at the open end of the launch tube 52 through which the projectile 51 transits. At the same time, supercavitating flow 61 is forming at the cavitator 58 of the projectile 51. Expulsion gases within the rear section 54 of the launch tube 52 continue to urge the projectile 51 from the launch tube 52.

Now observing FIG. 5*c* illustrating the projectile 51 at an even later time during launch, expulsion gases in the rear section 54 of the launch tube continue to urge the projectile 51 from the launch tube 52. However the gas bubbles 60 and 61 from FIG. 5*b* have now coalesced providing a single gas bubble 62 within which the projectile 51 is propagating. This gas bubble 62 has formed prior to the projectile 51 entirely exiting the launch tube 52. As such skin drag is significantly reduced, and friction effects within the launch tube have been reduced owing to the air flow around the projectile 51. The cavitator 58 continues to generate supercavitating flow as the projectile 51 fully exits the launch tube and continues towards a target. Overall the projectile experiences reduced transit time and improved stability.

Whilst the embodiments shown are intended for use underwater, the advantages of the invention may be achievable in other fluids such as air. The cavitator described is an example of a supercavitating structure and other geometries may be used in other embodiments of the invention, provided that such geometries generate supercavitating flow within the chosen fluid of deployment. The projectile has been described as a single unitary mass, however the projectile may in other embodiments be a vessel for transporting other objects. For instance the projectile may comprise a shell within which a dart can be transported to an intended target, the shell breaking upon impact with the intended target to reveal the dart for penetrating the target. Additionally, grooves may be provided on an external surface of the projectile interfacing with the interior surface of a launch tube to define channels for gas flow. Angling may be applied to the grooves at approximately 45 degrees or other angle to the major axis of the projectile such that in use a degree of rifling is imparted to the projectile during launch by virtue of the flow of high pressure gas.

The invention claimed is:

1. Projectile launch apparatus for use in a fluid environment, comprising a launch tube having a closed end and an open end, a supercavitating projectile received between the ends separating the launch tube into a forward section comprising the open end and a rear section comprising the closed end, and gas generation means arranged to provide expulsion gas into the rear section of the launch tube, such that in-use trapped expulsion gases within the rear section generate a pressure increase that acts on the supercavitating projectile to propel the projectile through the open end, wherein the supercavitating projectile comprises a nose section and a tail section, the nose section having a cavitator for generating a gas cavity around the supercavitating projectile when the projectile is launched, wherein the projectile launch apparatus further comprises means for bleeding expulsion gas around the projectile from the rear section of the launch tube into the forward section and thereby to the open end, such that in-use, expulsion gases can contribute to a formation of the gas cavity around the supercavitating projectile as the projectile is launched through the open end.

2. The projectile launch apparatus of claim 1, wherein the supercavitating projectile is banded with at least one discrete band to form a bore riding projectile, the at least one discrete band being conformal to an interior surface of the launch tube.

3. The projectile launch apparatus of claim 2, wherein the supercavitating projectile is banded with at least two discrete bands.

4. The projectile launch apparatus of claim 2, wherein the bands are formed from Nylon or PTFE.

5. The projectile launch apparatus of claim 2, wherein the means for bleeding expulsion gas comprises conduits extending through the discrete bands for a flow of expulsion gases from the rear section to the forward section of the launch tube.

6. The projectile launch apparatus of claim 2, wherein the means for bleeding expulsion gas comprises a clearance gap between an exterior surface of the supercavitating projectile and the interior surface of the launch tube.

7. The projectile launch apparatus of claim 6, wherein the clearance gap is less than 2 mm.

8. The projectile launch apparatus of claim 6, wherein the clearance gap is less than or equal to 100 μm between the at least one discrete band and interior surface of the launch tube.

9. The projectile launch apparatus of claim 1, wherein the means for bleeding expulsion gas comprises a groove in an exterior surface of the supercavitating projectile and/or an interior surface of the launch tube, the groove extending between the rear section and the forward section such that the exterior surface of the supercavitating projectile and interior surface of the launch tube define a channel through which expulsion gases can flow.

10. The projectile launch apparatus of claim 1, wherein the supercavitating projectile comprises an internal conduit connecting the rear section of the launch tube with the forward section, through which expulsion gases can flow.

11. The projectile launch apparatus of claim 10, wherein the internal conduit takes the form of a spiral about the major axis of the supercavitating projectile.

12. The projectile launch apparatus of claim 1, further comprising initiation means for initiating the means for bleeding expulsion gas when the pressure in the rear section of the launch tube exceeds a predetermined threshold pressure value.

13. The projectile launch apparatus of claim 12, wherein the initiation means comprises a shear band attached to the tail section of the supercavitating projectile.

14. The projectile launch apparatus of claim 12, wherein the initiation means comprises an internal tapering of the rear section of the launch tube and a conformal tapering of the tail section of the supercavitating projectile.

15. The projectile launch apparatus of claim 1, wherein the cavitator comprises a plurality of stacked sections increasing in diameter in a nose-to-tail direction.

16. The projectile launch apparatus of claim 15, wherein each stacked section in the plurality of stacked sections is a cylindrical stacked section.

17. The projectile launch apparatus of claim 16, wherein the cavitator comprises an annular recess extending around a periphery of an interface between each stacked section.

18. The projectile launch apparatus of claim 1, further comprising an inflatable bladder having an opening for receiving a gas, the inflatable bladder being releasably mounted to the launch tube and arranged to receive through the opening a portion of the expulsion gas from the gas generation means when the projectile launch apparatus is in-use, such that the inflatable bladder can be deployed as a marker buoy.

19. The projectile launch apparatus of claim 18, wherein the opening of the inflatable bladder is arranged to collect expulsion gas exiting the open end of the launch tube when the projectile launch apparatus is in use.

20. The projectile launch apparatus of claim 18, wherein the buoy is attached to the launch tube or supercavitating projectile using rope or wire means.

21. The projectile launch apparatus of claim 1, wherein the supercavitating projectile further comprises decoupling means for rotationally decoupling the nose section from the tail section.

22. A torpedo comprising the projectile launch apparatus of claim 1.

23. The torpedo of claim 22 comprising a plurality of projectile launch apparatuses.

24. A method of launching a supercavitating projectile in a fluid environment, the method comprising:

(a) Locating the projectile launch apparatus of claim 1 in a fluid environment;

(b) Initiating the gas generation means to provide expulsion gas into the rear section of the launch tube;

(c) Bleeding expulsion gas around the projectile from the rear section of the launch tube into the forward section of the launch tube and thereby to the open end; and then (d) Launching the supercavitating projectile through the open end of the launch tube, such that expulsion gases can contribute to formation of the gas cavity around the supercavitating projectile as the projectile is launched through the open end.

* * * * *